US006780130B1

(12) United States Patent
Monochello

(10) Patent No.: US 6,780,130 B1
(45) Date of Patent: Aug. 24, 2004

(54) LIGHTED SHUTTLECOCK

(76) Inventor: Michael Monochello, 172 Ryerson Ave., Paterson, NJ (US) 07502

( * ) Notice: Subject to any disclaimer, the term of this patent is extended or adjusted under 35 U.S.C. 154(b) by 46 days.

(21) Appl. No.: 10/388,993

(22) Filed: Mar. 14, 2003

(51) Int. Cl.[7] ..... A63B 67/18
(52) U.S. Cl. ..... 473/570; 473/579
(58) Field of Search ..... 473/570, 578, 473/579; 273/DIG. 24

(56) References Cited

U.S. PATENT DOCUMENTS 3,997,162 A * 12/1976 Scullin ..... 273/348.3
5,562,290 A 10/1996 Wei
5,720,651 A 2/1998 Chien
6,142,894 A 11/2000 Lee

FOREIGN PATENT DOCUMENTS

GB 2241897 * 9/1991

* cited by examiner

*Primary Examiner*—Jacob K. Ackun, Jr.

(57) ABSTRACT

A lighted shuttlecock for allowing a game a badminton to be played in low light conditions. The lighted shuttlecock includes a body member comprising a feather crown portion and a tip portion. The tip portion is selectively coupled to the feather crown portion. The tip portion of the body member is designed for being struck by a racket to propel the body member through the air. The feather crown portion is designed for stabilizing the body member when the body member is flying through the air. A light assembly is positioned in the tip portion of the body member. The light assembly is designed for emitting light when the tip portion of the body member is struck by the racket whereby the light assembly is designed for facilitating locating the body member at night.

7 Claims, 3 Drawing Sheets

LIGHTED SHUTTLECOCK

BACKGROUND OF THE INVENTION

1. Field of the Invention

The present invention relates to illuminated equipment and more particularly pertains to a new lighted shuttlecock for allowing a game a badminton to be played in low light conditions.

2. Description of the Prior Art

The use of illuminated equipment is known in the prior art. U.S. Pat. No. 5,720,651 describes a system for illuminating a non-motor powered flying device. Another type of illuminated equipment is U.S. Pat. No. 5,562,290 having a shuttlecock having a luminol ball and an alkaline solution in a base of the shuttlecock to emit light so that the light is continuous throughout the use of the shuttlecock. U.S. Pat. No. 6,142,894 has a sound and light producing apparatus positioned in an article for producing a sound and light when the article is impacted.

SUMMARY OF THE INVENTION

An object of the present invention is to provide a new lighted shuttlecock that allows a game a badminton to be played during low light conditions.

Even still another object of the present invention is to provide a new lighted shuttlecock that emits light for a predetermined amount of time thereby adding a degree of difficulty to striking the body member once the light assembly ceases to emit light.

To this end, the present invention generally comprises a body member comprising a feather crown portion and a tip portion. The tip portion is selectively coupled to the feather crown portion. The tip portion of the body member is designed for being struck by a racket to propel the body member through the air. The feather crown portion is designed for stabilizing the body member when the body member is flying through the air. A light assembly is positioned in the tip portion of the body member. The light assembly is designed for emitting light when the tip portion of the body member is struck by the racket whereby the light assembly is designed for facilitating locating the body member at night.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
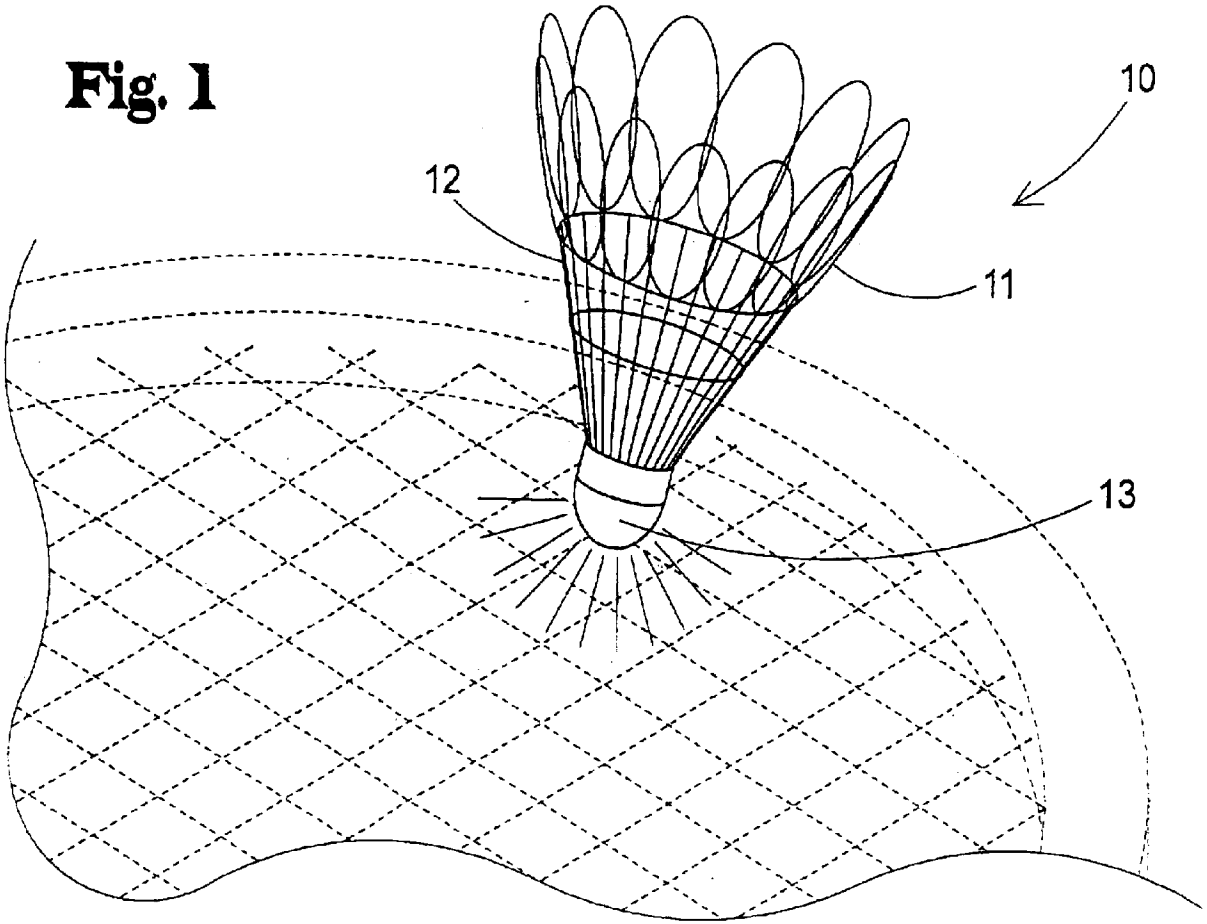
FIG. 1 is a perspective view of a new lighted shuttlecock according to the present invention shown in use.
Figure 2:
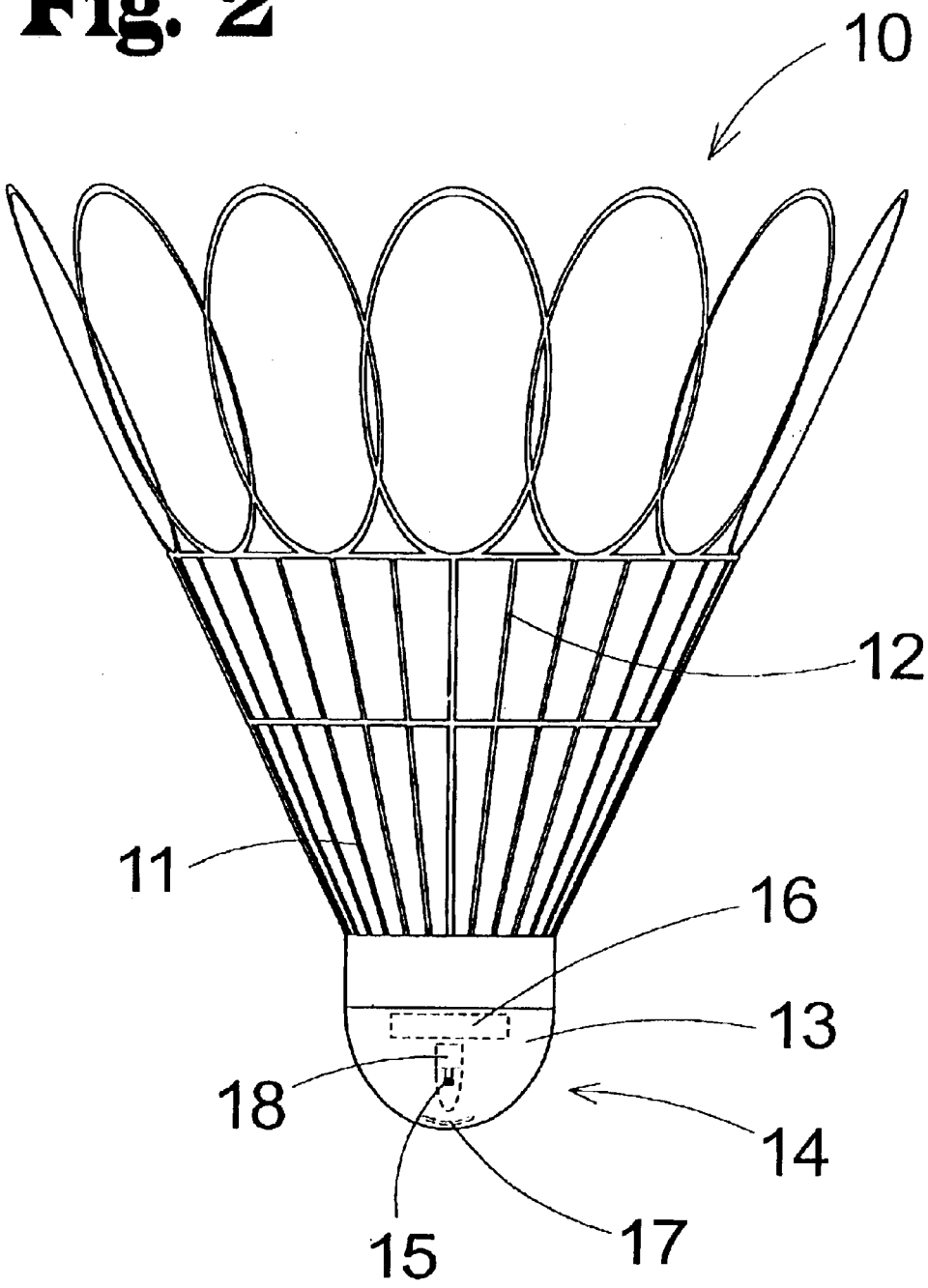
FIG. 2 is a perspective view of the present invention.
Figure 3:
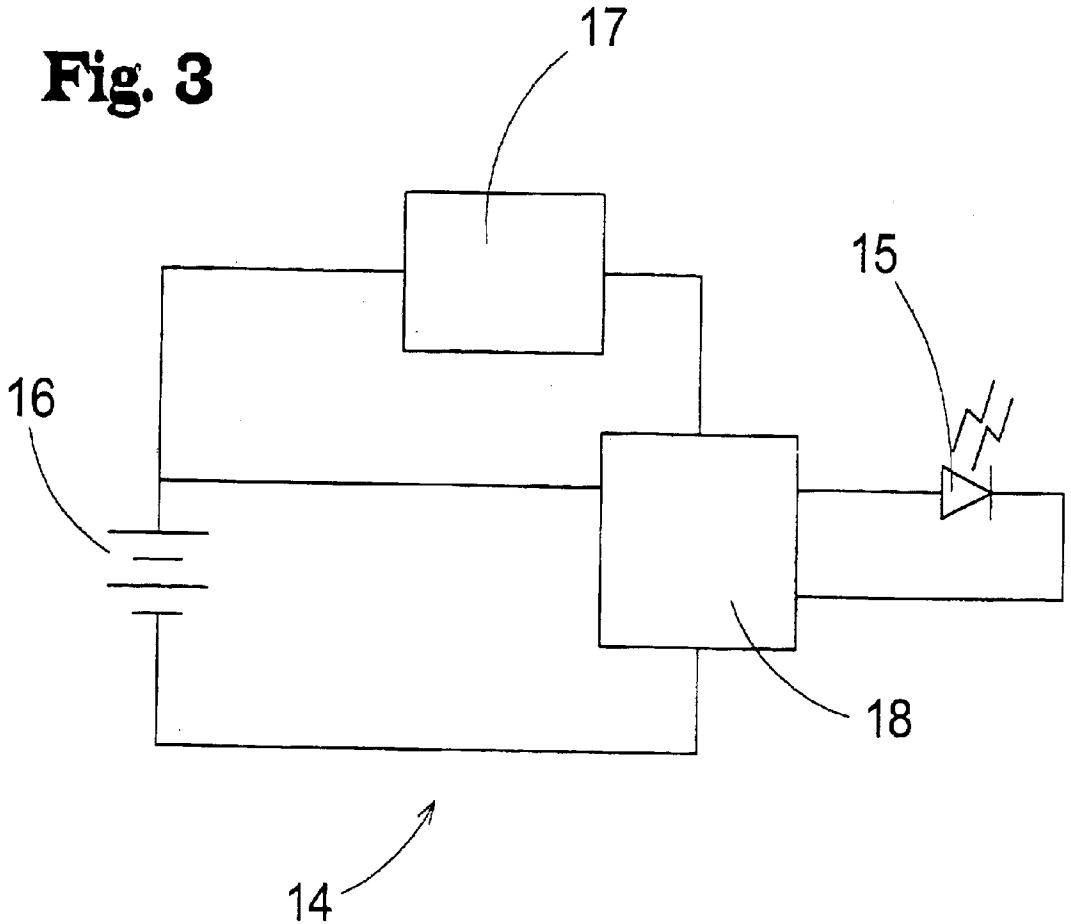
FIG. 3 is a schematic view of the present invention.

With reference now to the drawings, and in particular to FIGS. 1 through 3 thereof, a new lighted shuttlecock embodying the principles and concepts of the present invention and generally designated by the reference numeral 10 will be described.

As best illustrated in FIGS. 1 through 3, the lighted shuttlecock 10 generally comprises a body member 11 comprising a feather crown portion 12 and a tip portion 13. The tip portion 13 is selectively coupled to the feather crown portion 12. The tip portion 13 of the body member 11 is designed for being struck by a racket to propel the body member 11 through the air. The feather crown portion 12 is designed for stabilizing the body member 11 when the body member 11 is flying through the air. The tip portion 13 of the body member 11 comprises a semi-transparent material. The semi-transparent material is designed for letting light emitted from the light assembly 14 to be viewed by the user.

A light assembly 14 is positioned in the tip portion 13 of the body member 11. The light assembly 14 is designed for emitting light when the tip portion 13 of the body member 11 is struck by the racket whereby the light assembly 14 is designed for facilitating locating the body member 11 at night.

The light assembly 14 comprises a light emitting member 15 and a power source 16. The power source 16 is operationally coupled to the light emitting member 15 whereby the power source 16 supplies power to the light emitting member 15. The light emitting member 15 is designed for emitting light when the power source 16 is supplying power to the light emitting member 15. The light emitting member 15 is positioned in a center of the tip portion 13 of the body member 11 whereby the tip portion 13 of the body member 11 is designed for absorbing the impact of the racket with the tip portion 13 to inhibit damage of the light emitting member 15.

The light emitting member 15 comprises a light emitting diode. The light emitting diode is designed for emitting light when the power source 16 supplies power to the light emitting diode. The light emitting diode is designed for resisting being damaged when the tip portion 13 of the body member 11 is struck by the racket. The light emitting diode is unblinking and emits a red color when emitting light.

The light assembly 14 comprises an impact sensor 17. The impact sensor 17 is operationally coupled between the power source 16 and the light emitting member 15. The impact sensor 17 is designed for sensing an impact of the tip portion 13 of the body member 11 with the racket whereby the impact sensor 17 controls the flow of power from the power source 16 to the light emitting member 15 to emit light when the tip portion 13 of the body member 11 is struck by the racket. The impact sensor 17 is positioned proximate an apex of the tip portion 13 of the body member 11 whereby the impact sensor 17 is designed for being positioned to receive the force of the impact of the racket with the tip portion 13 to sense the impact to supply power to the light emitting member 15 to emit light.

The light assembly 14 comprises a timer assembly 18. The timer assembly 18 is operationally coupled between the impact sensor 17 and the light emitting member 15. The timer assembly 18 is for controlling the amount of time power flows to the light emitting member 15 to emit light when the impact sensor 17 sense the impact of the tip portion 13 with the racket. The timer assembly 18 would ideally allow the light emitting member 15 to emit light from about 10 seconds to about 20 seconds.

In use, the user strikes the tip portion 13 of the body member 11 with the racket to an opponent. The action of hitting the tip portion 13 actuates the impact sensor 17 which actuates the timer assembly 18 to allow power to flow to the light emitting member 15 and emit light so that the tip portion 13 is visible in low light conditions during a game of badminton. The opponent returns the body member 11 by striking the tip portion 13 with another racket and turns continue until the player or the opponent wins.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted shuttlecock for use during a game of badminton, the lighted shuttlecock comprising:

a body member comprising a feather crown portion and a tip portion, said tip portion being selectively coupled to said feather crown portion, said tip portion of said body member being adapted for being struck by a racket to propel said body member through the air, said feather crown portion being adapted for stabilizing said body member when said body member is flying through the air;

a light assembly being positioned in said tip portion of said body member, said light assembly being adapted for emitting light when said tip portion of said body member is struck by the racket such that said light assembly is adapted for facilitating locating said body member at night;

said light assembly comprising a light emitting member and a power source, said power source being operationally coupled to said light emitting member such that said power source supplies power to said light emitting member, said light emitting member being adapted for emitting light when said power source is supplying power to said light emitting member; and said light assembly comprising an impact sensor, said impact sensor being operationally coupled between said power source and said light emitting member, said impact sensor being adapted for sensing an impact of said tip portion of said body member with the racket such that said impact sensor controls the flow of power from said power source to said light emitting member to emit light when said tip portion of said body member is struck by the racket.

2. The lighted shuttlecock as set forth in claim 1, further comprising:

said light emitting member comprising a light emitting diode, said light emitting diode being adapted for emitting light when said power source supplies power to said light emitting diode, said light emitting diode being adapted for resisting being damaged when said tip portion of said body member is struck by the racket.

3. The lighted shuttlecock as set forth in claim 1, further comprising:

said light emitting member being positioned in a center of said tip portion of said body member such that said tip portion of said body member is adapted for absorbing the impact of the racket with said tip portion to inhibit damage of said light emitting member.

4. The lighted shuttlecock as set forth in claim 1, further comprising:

said impact sensor being positioned proximate an apex of said tip portion of said body member such that said impact sensor is adapted for being positioned to receive the force of the impact of the racket with said tip portion to sense the impact to supply power to the light emitting member to emit light.

5. The lighted shuttlecock as set forth in claim 1, further comprising:

said light assembly comprising a timer assembly, said timer assembly being operationally coupled between said impact sensor and said light emitting member, said timer assembly being for controlling the amount of time power flows to said light emitting member to emit light when said impact sensor sense the impact of said tip portion with the racket.

6. The lighted shuttlecock as set forth in claim 1, further comprising:

said tip portion of said body member comprising a semi-transparent material, said semi-transparent material being adapted for letting light emitted from said light assembly to be viewed by the user.

7. A lighted shuttlecock for use during a game of badminton, the lighted shuttlecock comprising:

a body member comprising a feather crown portion and a tip portion, said tip portion being selectively coupled to said feather crown portion, said tip portion of said body member being adapted for being struck by a racket to propel said body member through the air, said feather crown portion being adapted for stabilizing said body member when said body member is flying through the air;

a light assembly being positioned in said tip portion of said body member, said light assembly being adapted for emitting light when said tip portion of said body member is struck by the racket such that said light assembly is adapted for facilitating locating said body member at night;

said light assembly comprising a light emitting member and a power source, said power source being operationally coupled to said light emitting member such that said power source supplies power to said light emitting member, said light emitting member being adapted for emitting light when said power source is supplying power to said light emitting member;

said light emitting member comprising a light emitting diode, said light emitting diode being adapted for emitting light when said power source supplies power to said light emitting diode, said light emitting diode being adapted for resisting being damaged when said tip portion of said body member is struck by the racket;

said light emitting member being positioned in a center of said tip portion of said body member such that said tip portion of said body member is adapted for absorbing the impact of the racket with said tip portion to inhibit damage of said light emitting member;

said light assembly comprising an impact sensor, said impact sensor being operationally coupled between said power source and said light emitting member, said impact sensor being adapted for sensing an impact of said tip portion of said body member with the racket such that said impact sensor controls the flow of power from said power source to said light emitting member to emit light when said tip portion of said body member is struck by the racket;

said impact sensor being positioned proximate an apex of said tip portion of said body member such that said impact sensor is adapted for being positioned to receive the force of the impact of the racket with said tip portion to sense the impact to supply power to the light emitting member to emit light;

said light assembly comprising a timer assembly, said timer assembly being operationally coupled between said impact sensor and said light emitting member, said timer assembly being for controlling the amount of time power flows to said light emitting member to emit light when said impact sensor sense the impact of said tip portion with the racket; and said tip portion of said body member comprising a semi-transparent material, said semi-transparent material being adapted for letting light emitted from said light assembly to be viewed by the user.

* * * * *